US009024981B2

(12) United States Patent
Yamada

(10) Patent No.: US 9,024,981 B2
(45) **Date of Patent: *May 5, 2015**

(54) CONTROL DEVICE, DISPLAY DEVICE, ELECTRONIC APPARATUS AND CONTROLLING METHOD

(71) Applicant: Seiko Epson Corporation, Tokyo (JP)

(72) Inventor: Toshimichi Yamada, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

This patent is subject to a terminal disclaimer.

(21) Appl. No.: 13/853,569

(22) Filed: Mar. 29, 2013

(65) Prior Publication Data

US 2013/0265339 A1 Oct. 10, 2013

(30) Foreign Application Priority Data

Apr. 6, 2012 (JP) ..... 2012-087510

(51) Int. Cl.
*G09G 5/10* (2006.01)
*G09G 3/34* (2006.01)

(52) U.S. Cl.
CPC ..... *G09G 3/344* (2013.01); *G09G 2300/0842* (2013.01); *G09G 2320/0204* (2013.01); *G09G 2320/0285* (2013.01)

(58) Field of Classification Search
CPC ..... G09G 3/344; G09G 2320/0204; G09G 2320/0285; G09G 2300/0842
USPC ..... 345/36, 63, 104, 107, 204–214, 601, 345/690–692; 359/237–241, 665, 666
See application file for complete search history.

(56) References Cited

U.S. PATENT DOCUMENTS

| | | | | |
|---|---|---|---|---|
| 6,078,303 | A * | 6/2000 | McKnight | 345/87 |
| 2002/0044122 | A1 | 4/2002 | Kuwata et al. | |
| 2003/0112386 | A1* | 6/2003 | Bu | 349/96 |
| 2004/0125090 | A1* | 7/2004 | Hudson | 345/204 |
| 2004/0201564 | A1 | 10/2004 | Sugino et al. | |
| 2004/0263495 | A1 | 12/2004 | Sugino et al. | |
| 2005/0024310 | A1 | 2/2005 | Shiomi et al. | |
| 2005/0156838 | A1 | 7/2005 | Miyagawa et al. | |
| 2006/0139310 | A1* | 6/2006 | Zehner et al. | 345/107 |
| 2007/0057906 | A1* | 3/2007 | Johnson et al. | 345/107 |
| 2007/0216623 | A1* | 9/2007 | Kimura | 345/89 |
| 2008/0211756 | A1 | 9/2008 | Shiomi et al. | |
| 2008/0291223 | A1* | 11/2008 | Yamazaki et al. | 345/690 |

(Continued)

FOREIGN PATENT DOCUMENTS

| | | | |
|---|---|---|---|
| CN | 101840666 | A | 9/2010 |
| JP | 2001-331144 | A | 11/2001 |

(Continued)

*Primary Examiner* — Prabodh M Dharia
(74) *Attorney, Agent, or Firm* — ALG Intellectual Property, LLC

(57) ABSTRACT

An application control changes a first image displayed with a plurality of pixels composing the entirety or a part of a display section to an image in the first gray level displayed with the plurality of pixels, and thereafter display a second image displayed with the plurality of pixels. Also, the application control device controls an application device such that the numbers of application of the first voltage and the second voltage to each of the plurality of pixels are equal to each other from a state in which each of the plurality of pixels lastly assumes the first gray level before the first image is displayed until a state in which each of the plurality of pixels first assumes the first gray level after the first image is displayed.

8 Claims, 18 Drawing Sheets

(56) References Cited

U.S. PATENT DOCUMENTS

| | | | | |
|---|---|---|---|---|
| 2009/0040201 | A1* | 2/2009 | Kim et al. | 345/204 |
| 2009/0058779 | A1 | 3/2009 | Yoshihara et al. | |
| 2009/0167754 | A1* | 7/2009 | Hatta | 345/214 |
| 2009/0256798 | A1 | 10/2009 | Low et al. | |
| 2010/0220122 | A1* | 9/2010 | Zehner et al. | 345/690 |
| 2010/0231571 | A1 | 9/2010 | Tanabe | |
| 2011/0285755 | A1* | 11/2011 | Umezaki | 345/690 |
| 2012/0162545 | A1 | 6/2012 | Shiomi et al. | |
| 2012/0200554 | A1* | 8/2012 | Kim et al. | 345/211 |
| 2012/0262498 | A1 | 10/2012 | Kanamori et al. | |
| 2012/0262505 | A1 | 10/2012 | Muto et al. | |
| 2012/0287175 | A1* | 11/2012 | Yamada | 345/690 |

FOREIGN PATENT DOCUMENTS

| | | | |
|---|---|---|---|
| JP | 2002-311900 | A | 10/2002 |
| JP | 2002-366103 | A | 12/2002 |
| JP | 2003-207762 | A | 7/2003 |
| JP | 2004-85606 | A | 3/2004 |
| JP | 2004-302460 | A | 10/2004 |
| JP | 2004-348151 | A | 12/2004 |
| JP | 2005-181917 | A | 7/2005 |
| JP | 2008-20858 | A | 1/2008 |
| JP | 2009-251615 | A | 10/2009 |
| JP | 2012-220826 | A | 11/2012 |
| JP | 2012-225983 | A | 11/2012 |
| JP | 2012-237958 | A | 12/2012 |
| WO | WO-2007-116438 | A | 10/2007 |

* cited by examiner

| Initial Value | 0(Black) | 0(Black) | 1(White) | 1(White) |
|---|---|---|---|---|
| Target Value | 0(Black) | 1(White) | 0(Black) | 1(White) |
| TID | 1 | 2 | 3 | 4 |

FIG. 9

| INDEX | Application Voltage | | | |
|---|---|---|---|---|
| | TID=1 | TID=2 | TID=3 | TID=4 |
| 20 | w | w | o | o |
| 19 | w | w | o | o |
| 18 | w | w | o | o |
| 17 | w | w | o | o |
| 16(All-White) | o | o | o | o |
| 15 | b | b | b | b |
| 14 | b | b | b | b |
| 13 | b | b | b | b |
| 12 | b | b | b | b |
| 11(All-Black) | o | o | o | o |
| 10 | w | w | w | w |
| 9 | w | w | w | w |
| 8 | w | w | w | w |
| 7 | w | w | w | w |
| 6(All-White) | o | o | o | o |
| 5 | b | o | b | o |
| 4 | b | o | b | o |
| 3 | b | o | b | o |
| 2 | b | o | b | o |
| 1 | o | o | o | o |

FIG. 10

Image data
A(j,i)

| | | | |
|---|---|---|---|
| 1 | 1 | 1 | 1 |
| 1 | 1 | 1 | 1 |
| 1 | 1 | 1 | 1 |
| 1 | 1 | 1 | 1 |

FIG. 11A

Scheduled image data
B(j,i)

| | | | |
|---|---|---|---|
| 1 | 1 | 1 | 1 |
| 1 | 1 | 1 | 1 |
| 1 | 1 | 1 | 1 |
| 1 | 1 | 1 | 1 |

FIG. 11B

Table ID
C(j,i)

| | | | |
|---|---|---|---|
| 0 | 0 | 0 | 0 |
| 0 | 0 | 0 | 0 |
| 0 | 0 | 0 | 0 |
| 0 | 0 | 0 | 0 |

FIG. 11C

Index
D(j,i)

| | | | |
|---|---|---|---|
| 0 | 0 | 0 | 0 |
| 0 | 0 | 0 | 0 |
| 0 | 0 | 0 | 0 |
| 0 | 0 | 0 | 0 |

FIG. 11D

Image being displayed
P(j,i)

| | | | |
|---|---|---|---|
| 1 | 1 | 1 | 1 |
| 1 | 1 | 1 | 1 |
| 1 | 1 | 1 | 1 |
| 1 | 1 | 1 | 1 |

FIG. 11E

| | | | |
|---|---|---|---|
| 1 | 1 | 0 | 0 |
| 1 | 1 | 0 | 0 |
| 0 | 0 | 1 | 1 |
| 0 | 0 | 1 | 1 |

Image data
A(j,i)

FIG. 13A

| | | | |
|---|---|---|---|
| 1 | 1 | 0 | 0 |
| 1 | 1 | 0 | 0 |
| 0 | 0 | 1 | 1 |
| 0 | 0 | 1 | 1 |

Scheduled image data
B(j,i)

FIG. 13B

| | | | |
|---|---|---|---|
| 4 | 4 | 3 | 3 |
| 4 | 4 | 3 | 3 |
| 3 | 3 | 4 | 4 |
| 3 | 3 | 4 | 4 |

Table ID
C(j,i)

FIG. 13C

| | | | |
|---|---|---|---|
| 20 | 20 | 20 | 20 |
| 20 | 20 | 20 | 20 |
| 20 | 20 | 20 | 20 |
| 20 | 20 | 20 | 20 |

Index
D(j,i)

FIG. 13D

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Image being displayed
P(j,i)

FIG. 13E

| | | | |
|---|---|---|---|
| 1 | 1 | 0 | 0 |
| 1 | 1 | 0 | 0 |
| 0 | 0 | 1 | 1 |
| 0 | 0 | 1 | 1 |

Image data

A(j,i)

FIG. 14A

| | | | |
|---|---|---|---|
| 1 | 1 | 0 | 0 |
| 1 | 1 | 0 | 0 |
| 0 | 0 | 1 | 1 |
| 0 | 0 | 1 | 1 |

Scheduled image data

B(j,i)

FIG. 14B

| | | | |
|---|---|---|---|
| 4 | 4 | 3 | 3 |
| 4 | 4 | 3 | 3 |
| 3 | 3 | 4 | 4 |
| 3 | 3 | 4 | 4 |

Table ID

C(j,i)

FIG. 14C

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Index

D(j,i)

FIG. 14D

| | | | |
|---|---|---|---|
| 1 | 1 | 0 | 0 |
| 1 | 1 | 0 | 0 |
| 0 | 0 | 1 | 1 |
| 0 | 0 | 1 | 1 |

Image being displayed

P(j,i)

FIG. 14E

| INDEX | Application Voltage | | | |
|---|---|---|---|---|
| | TID=1 | TID=2 | TID=3 | TID=4 |
| 10 | w | w | o | o |
| 9 | w | w | o | o |
| 8 | w | w | o | o |
| 7 | w | w | o | o |
| 6(All-White) | o | o | o | o |
| 5 | b | o | b | o |
| 4 | b | o | b | o |
| 3 | b | o | b | o |
| 2 | b | o | b | o |
| 1 | o | o | o | o |

FIG. 15

| Initial Value | 0 (Black) | 0 (Black) | 2 (White) | 2 (White) | 1 (Gray) | 1 (Gray) | 2 (White) | 1 (Gray) | 0 (Black) |
|---|---|---|---|---|---|---|---|---|---|
| Target Value | 0 (Black) | 2 (White) | 0 (Black) | 2 (White) | 1 (Gray) | 2 (White) | 1 (Gray) | 0 (Black) | 1 (Gray) |
| TID | 1 | 2 | 3 | 4 | 5 | 6 | 7 | 8 | 9 |

FIG. 16

| INDEX | Application Voltage | | | | | | | | |
|---|---|---|---|---|---|---|---|---|---|
| | TID=1 | TID=2 | TID=3 | TID=4 | TID=5 | TID=6 | TID=7 | TID=8 | TID=9 |
| 10 | w | w | o | o | w | w | o | w | w |
| 9 | w | w | o | o | w | w | o | w | w |
| 8 | w | w | o | o | o | o | o | o | w |
| 7 | w | w | o | o | o | o | o | o | w |
| 6(All-White) | o | o | o | o | o | o | o | o | o |
| 5 | b | o | b | o | b | o | b | b | b |
| 4 | b | o | b | o | b | o | b | b | b |
| 3 | b | o | b | o | o | o | o | b | o |
| 2 | b | o | b | o | o | o | o | b | o |
| 1 | o | o | o | o | o | o | o | o | o |

FIG. 17

| INDEX | Application Voltage | | | |
|---|---|---|---|---|
| | TID=1 | TID=2 | TID=3 | TID=4 |
| 5 | o | w | b | o |
| 4 | o | w | b | o |
| 3 | o | w | b | o |
| 2 | o | w | b | o |
| 1 | o | o | o | o |

FIG. 18

CONTROL DEVICE, DISPLAY DEVICE, ELECTRONIC APPARATUS AND CONTROLLING METHOD

BACKGROUND

1. Technical Field

The present invention relates to a technology for rewriting an image by applying a voltage multiple times.

2. Related Art

JP-A-2009-251615 describes an electrophoretic type display device using microcapsules. The display device is an active matrix type, and is provided with drive circuits, each of which drives microcapsules at each of the intersections between a plurality of row electrodes extending in a row direction and a plurality of column electrodes extending in a column direction. White particles and black particles that are charged with mutually opposite polarities are contained in each of the microcapsules. Upon application of a voltage to the row electrode and the column electrode, a potential difference is generated between an electrode provided on the drive circuit and a counter electrode disposed opposite to the electrode through the microcapsules. As a result, white particles and black particles within the microcapsules migrate by the effect of electric fields generated by the potential difference, whereby the distribution of white particles and black particles changes and an image is displayed accordingly.

The electrophoretic type display device may use a drive method for rewriting an image in which pixels required to be rewritten are extracted, and voltage is applied only to pixel electrodes corresponding to the extracted pixels. This drive method achieves high-speed image rewriting, but may result in image blurring at pixels that are not rewritten, due to leakage of electric current from the pixel electrodes of the pixels that are rewritten to the pixel electrodes of the pixels that are not rewritten. Such blurring may be cancelled out by refreshing the pixels, but deterioration of the pixels may progress because of the imbalance caused in the polarities of voltages that have been impressed.

SUMMARY

In accordance with an advantage of some aspects of the invention, there is provided a technology for controlling deterioration of pixels in areas where current leakage occurs.

In accordance with an embodiment of the invention, a control device is provided for controlling a display device equipped with a display section having a plurality of first electrodes respectively corresponding to pixels, a second electrode provided opposite the plurality of first electrodes, and display elements placed between the first electrodes and the second electrode. The control device includes an application device that applies a first voltage to the first electrode multiple times when the gray level of the pixel is changed from a first gray level to a second gray level, and applies a second voltage with a polarity different from that of the first voltage to the first electrode multiple times when the gray level of the pixel is changed from the second gray level to the first gray level; and an application control device that controls the application device to change a first image displayed with a plurality of pixels composing the entirety or a part of the display section to an image in the first gray level displayed with the plurality of pixels, and thereafter display a second image with the plurality of pixels. The application control device controls the application device such that the numbers of application of the first voltage and the second voltage to each of the plurality of pixels become equal to each other from a state in which each of the plurality of pixels lastly assumes the first gray level before the first image is displayed until a state in which each of the plurality of pixels first assumes the first gray level after the first image is displayed. According to such a configuration, charges in the pixel electrodes caused by leakage current in the first image are cancelled out by charges in the pixel electrodes caused by leakage current in a state in which the gray level of the plurality of pixels is changed to the first gray level first time after the first image is displayed, whereby deterioration of the pixels in areas where current leakage occurs can be controlled.

In the control device, the application control device may control the application device such that the first image displayed with the plurality of pixels is sequentially changed to an image displayed in the first gray level with the plurality of pixels, to an image displayed in the second gray level with the plurality of pixels, to an image displayed in the first gray level with the plurality of pixels, and to the second image. According to such a configuration, color blurring that may be caused by leakage current can be controlled.

In the control device, the application control device may control the application device such that the first image displayed with the plurality of pixels is sequentially changed to an image displayed in the first gray level with the plurality of pixels, and to the second image. According to such a configuration, rewriting of an image can be performed at high speed.

In the control device, the application control device may control the application device with a highest or a lowest gray level among M gray levels ($3 \leq M$) as the first gray level. According to such a configuration, the effect of controlling blurring can be enhanced, compared with the case where an intermediate gray level is used as the first gray level.

In the control device, the application control device may control the application device with an intermediate gray level among M gray levels ($3 \leq M$) as the first gray level. According to such a configuration, rewriting of an image using relatively numerous intermediate gray levels can be performed at high speed.

In accordance with another embodiment of the invention, a display device includes a display section having a plurality of first electrodes respectively corresponding to pixels, a second electrode provided opposite the plurality of first electrodes, and display elements placed between the first electrodes and the second electrode, and the control device described above.

In accordance with still another embodiment of the invention, an electronic apparatus includes the display device described above.

In accordance with yet another embodiment of the invention, a control method is provided for controlling a display device equipped with a display section having a plurality of first electrodes respectively corresponding to pixels, a second electrode provided opposite the plurality of first electrodes, and display elements placed between the first electrodes and the second electrode. The control method includes an application processing of applying a first voltage to the first electrode multiple times when the gray level of the pixel is changed from a first gray level to a second gray level, and applying a second voltage with a polarity different from that of the first voltage to the first electrode multiple times when the gray level of the pixel is changed from the second gray level to the first gray level; and an application control processing of controlling voltage application in the application processing to change a first image displayed with a plurality of pixels composing the entirety or a part of the display section to an image in the first gray level displayed with the plurality of pixels, and thereafter display a second image with the plurality of pixels. The application control processing device controls voltage application in the application processing such that the first voltage and the second voltage are applied in the same number to each of the plurality of pixels from a state in which each of the plurality of pixels lastly assumes the first gray level before the first image is displayed until a state in which each of the plurality of pixels first assumes the first gray level after the first image is displayed.

BRIEF DESCRIPTION OF THE DRAWINGS

FIG. 9 shows an ID table.

FIG. 10 shows a drive table.

FIGS. 11A-11E show memory regions of VRAM 40 and RAM 50.

FIGS. 13A-13E show memory contents of each of the memory regions.

FIGS. 14A-14E show memory contents of each of the memory regions.

FIG. 15 shows a drive table.

FIG. 16 shows an ID table.

FIG. 17 shows a drive table.

FIG. 18 shows a drive table.

DESCRIPTION OF EXEMPLARY EMBODIMENTS

Configuration of Embodiment

Figure 1:
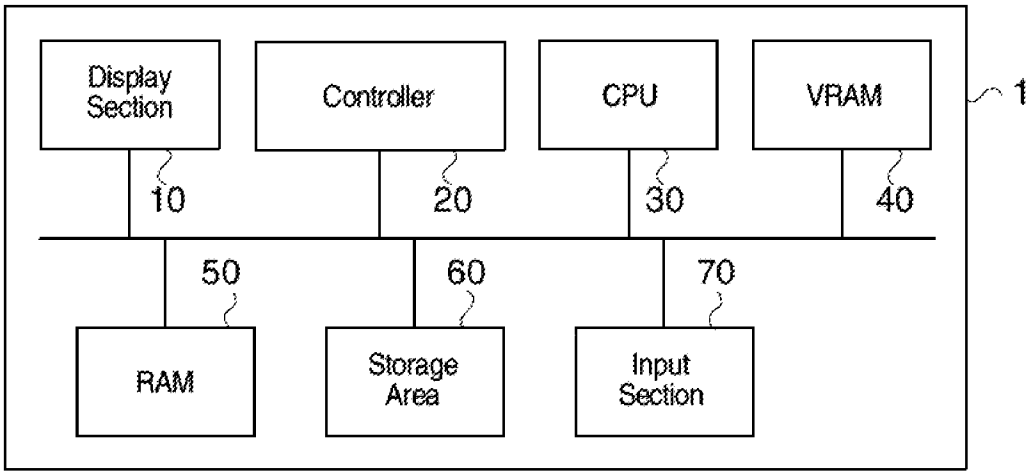
FIG. 1 is a block diagram showing a hardware configuration of an electronic apparatus 1.

FIG. 1 is a block diagram showing a hardware configuration of an electronic apparatus 1. The electronic apparatus 1 is a display device for displaying an image. In this example, the electronic apparatus 1 is a device for reading electronic books (an example of documents), in other words, an electronic book reader. The electronic apparatus 1 is equipped with a display section 10, a controller 20, a CPU 30, a VRAM 40, a RAM 50, a memory part 60, and an input section 70. The display section 10 has a display panel including display elements for displaying an image. In this example, the display elements include display elements using electrophoretic particles, as display elements having the memory-property that retains a display state without supplying energy through voltage application or the like. The display section 10 displays an image in monochrome multiple gray levels (in this example, two gray levels of black and white) with the display elements. The controller 20 is a control device that controls the display section 10. The CPU 30 is a device that controls each of the parts of the electronic apparatus 1. The CPU 30 uses the RAM 50 as a work area, and executes programs stored in a ROM (not shown) or the memory part 60. The VRAM 40 is a memory that stores image data indicative of an image to be displayed on the display section 10. The RAM 50 is a volatile memory that stores data. The storage part 60 is a storage device that stores various data and application programs, in addition to data of electronic books (book data), and includes an HDD or a nonvolatile memory such as a flash memory. The storage part 60 is capable of storing data of a plurality of electronic books. The input part 70 is an input device for inputting user's instructions, and includes, for example, a touch screen, key pads, buttons and the like. The components described above are interconnected through a bus.

Figure 2:
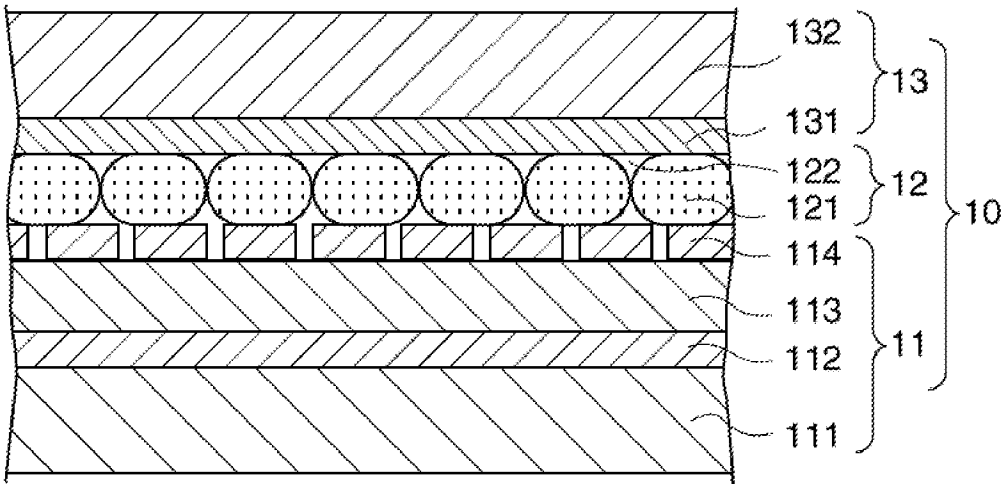
FIG. 2 is a schematic cross-sectional view of the structure of a display section 10.

FIG. 2 is a schematic view of the cross-sectional structure of the display section 10. The display section 10 includes a first substrate 11, an electrophoretic layer 12, and a second substrate 13. The first substrate 11 and the second substrate 13 are substrates that retain the electrophoretic layer 12.

The first substrate 11 includes a substrate 111, a bonding layer 112 and a circuit layer 113. The substrate 111 is made of a material having dielectric property and flexibility, for example, a polycarbonate substrate. The substrate 111 may be made of any resin material that is light-weight, flexible, elastic and dielectric, without any particular limitation to polycarbonate. As another example, the substrate 111 may be formed from glass material without flexibility. The bonding layer 112 is a layer that bonds the substrate 111 and the circuit layer 113 together. The circuit layer 113 is a layer having a circuit for driving the electrophoretic layer 12. The circuit layer 113 has pixel electrodes 114 (an example of the first electrode).

The electrophoretic layer 12 includes microcapsules 121 and a binder 122. The microcapsules 121 are fixed by the binder 122. The binder 122 may be made of any material that has good affinity with the microcapsules 121, excellent adhesion to the electrodes, and dielectric property. Each of the microcapsules 121 is a capsule containing a dispersion medium and electrophoretic particles. The microcapsules 121 may preferably be made of a material having flexibility, such as, composites of gum arabic and gelatin, urethane compounds, and the like. It is noted that an adhesive layer made of adhesive may be provided between the microcapsules 121 and the pixel electrodes 114.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); and carboxylates. Also, the dispersion medium may be made of any one of other various oils. The dispersion medium may use any of the materials described above in combination. Further, in another example, the dispersion medium may be further mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 121. The black electrophoretic particles are particles including black pigments, such as, for example, aniline black, carbon black and the like, and are positively charged in the present embodiment. The white electrophoretic particles are particles including white pigment, such as, for example, titanium dioxide, aluminum oxide and the like, and are negatively charged in the present embodiment.

The second substrate 13 includes a common electrode 131 (an example of a second electrode) and a film 132. The film 132 seals and protects the electrophoretic layer 12. The film 132 may be formed from a material that is transparent and has a dielectric property, such as, for example, polyethylene terephthalate. The common electrode 131 is made of a transparent conductive material, such as, for example, indium tin oxide (ITO).

Figure 3:
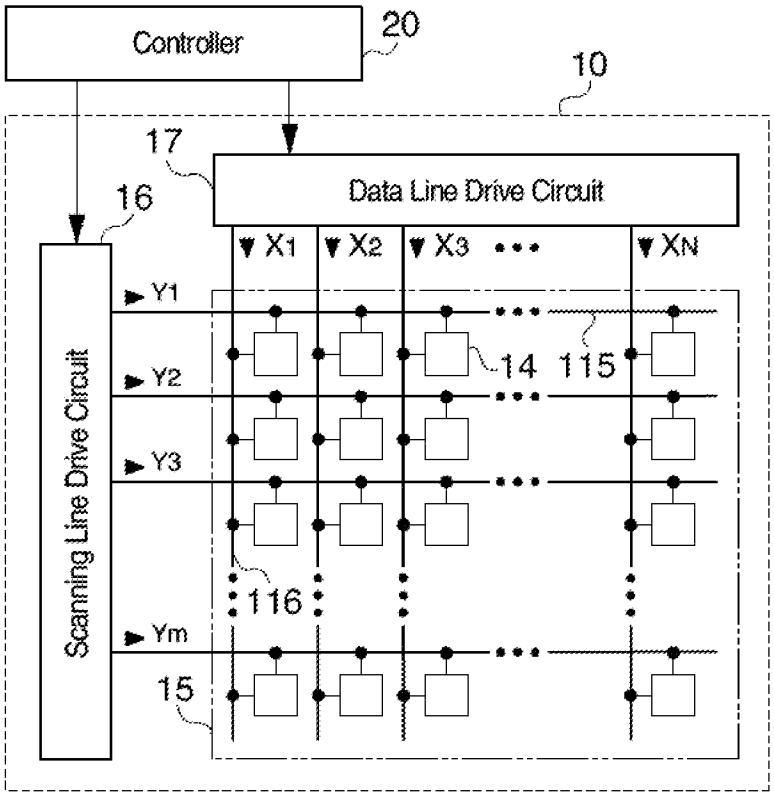
FIG. 3 is a diagram showing a circuit configuration of the display section 10.

FIG. 3 is a diagram showing a circuit configuration of the display section 10. The display section 10 includes m scanning lines 115, n data lines 116, m×n pixels 14, a scanning line drive circuit 16, and a data line drive circuit 17. The scanning line drive circuit 16 and the data line drive circuit 17 are controlled by the controller 20. The scanning lines 115 are arranged along a row direction (x direction), and transmit a scanning signal. The scanning signal is a signal that sequentially, exclusively selects one scanning line 115 from among the m scanning lines 115. The data lines 116 are arranged along a column direction (y direction), and transmit data signals. The data signals are signals indicative of gray levels of each pixel. The scanning lines 115 are insulated from the data lines 116. The pixels 14 are provided at positions corresponding to intersections between the scanning lines 115 and the data lines 116, and exhibit gray levels according to the respective data signals. It is noted that, when one scanning line 115 among the plurality of scanning lines 115 needs to be distinguished from the others, it is called the scanning line 115 in the first row, the second row, . . . , or the $m^{-th}$ row. The data lines 116 may be similarly distinguished. The m×n pixels 14 form a display area 15. Among the display area 15, when a pixel 14 at the $i^{-th}$ row and the $j^{-th}$ column is to be distinguished from the others, it is referred to as a pixel (j, i). Parameters that have one-to-one correspondence with the pixels 14, such as, gray level values and the like are similarly expressed.

The scanning line drive circuit 16 outputs a scanning signal Y for sequentially, exclusively selecting one scanning line 115 from among the m scanning lines 115. The scanning signal Y is a signal that sequentially, exclusively becomes to be H (High) level. The data line drive circuit 17 outputs data signals X. The data signals X are signals indicative of data voltages corresponding to gray level values of pixels. The data line drive circuit 17 outputs data signals indicative of data voltages corresponding to pixels in a row selected by the scanning signal.

Figure 4:
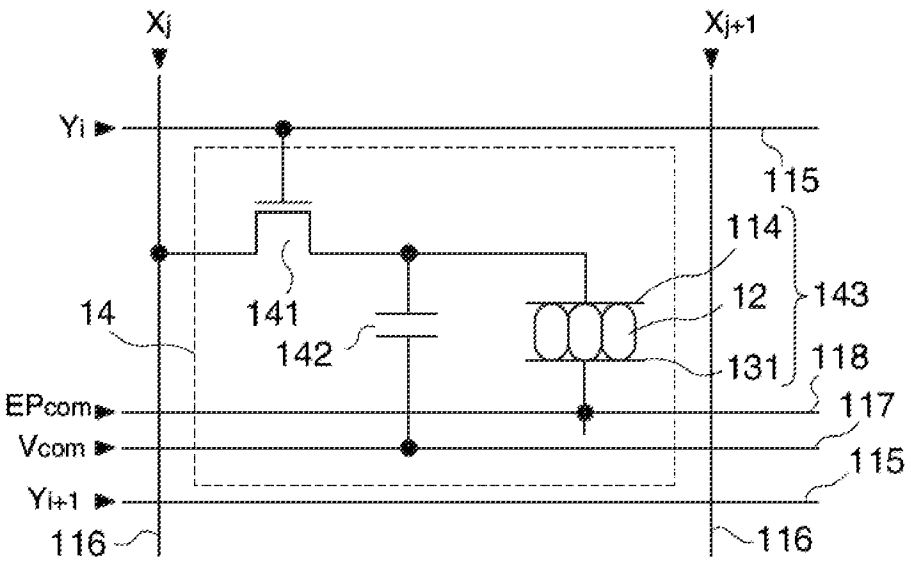
FIG. 4 is a view showing an equivalent circuit of a pixel 14.

FIG. 4 is a diagram showing an equivalent circuit of the pixel 14. The pixel 14 includes a transistor 141, a capacitance 142, a pixel electrode 114, an electrophoretic layer 12, and a common electrode 131. The transistor 141 is a switching element for controlling data writing to the pixel electrode 114, for example, an n-channel TFT (Thin Film Transistor). The transistor 141 includes a gate, a source and a drain, connected to the scanning line 115, the data line 116 and the pixel electrode 114, respectively. When a scanning signal at L (Low) level (non-selection signal) is inputted in the gate, the source and the drain of the transistor 141 become insulated from each other. When a scanning signal at H (High) level (selection signal) is inputted in the gate, the source and the drain of the transistor 141 become conductively connected to each other, and a data voltage is written to the pixel electrode 114. Also, the drain of the transistor 141 connects to the capacitance 142. The other end of the capacitance 142 connects to a capacitance wiring 117 having a potential Vcom. The capacitance 142 retains a charge according to the data voltage.

The pixel electrode 114 is provided at each of the pixels 14, and disposed opposite the common electrode 131. The common electrode 131 is commonly shared by the entire pixels 14, and is given a potential EPcom through a common electrode wiring 118. The potential EPcom may be set to the same potential as the potential Vcom. The electrophoretic layer 12 is held between the pixel electrode 114 and the common electrode 131. The pixel electrode 114, the electrophoretic layer 12 and the common electrode 131 form an electrophoretic element 143. A voltage corresponding to a potential difference between the pixel electrode 114 and the common electrode 131 is applied to the electrophoretic layer 12. In the microcapsules 121, the electrophoretic particles move according to a voltage applied to the electrophoretic layer 12, thereby expressing a gray level. When the potential on the pixel electrodes 114 is positive (for example, +15V) with respect to the potential EPcom on the common electrode 131, the negatively charged white electrophoretic particles move toward the pixel electrode 114, and the positively charged black electrophoretic particles move toward the common electrode 131. In this instance, as the display section 10 is viewed from the side of the second substrate 13, the pixels appear in black. When the potential on the pixel electrodes 114 is negative (for example, −15V) with respect to the potential EPcom on the common electrode 131, the positively charged black electrophoretic particles move toward the pixel electrodes 114, and the negatively charged white electrophoretic particles move toward the common electrode 131. In this instance, the pixels appear in white.

In the following description, a period starting from the selection of the scanning line in the $1^{st}$ row by the scanning line drive circuit 16 until the completion of the selection of the scanning line in the $m^{-th}$ row is referred to as a "frame period" or, simply a "frame". Each of the scanning lines 115 is selected once in each frame, and a data signal is supplied to each of the pixels 14 once in each frame.

Figure 5:
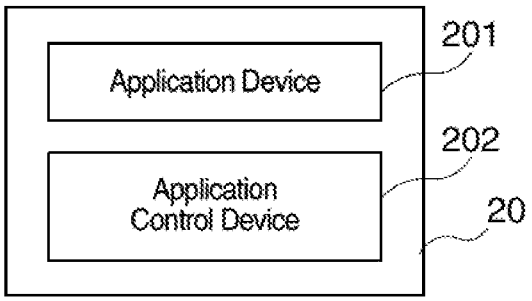
FIG. 5 is a diagram showing a functional configuration of a controller 20.

FIG. 5 is a diagram showing a functional configuration of the controller 20. The controller 20 includes an application device 201 and an application control device 202. The application device 201 applies a first voltage N times (2≤N) to the pixel electrode 114, when the gray level of the pixel 14 is changed from a first gray level to a second gray level, and applies a second voltage having a polarity different from that of the first voltage to the pixel electrode 114 N times, when the gray level of the pixel 14 is changed from the second gray level to the first gray level.

Details of the function described above are as follows. In the present embodiment, the first gray level corresponds to white, and the second gray level corresponds to black. A first image and a second image are images based on image data stored in the VRAM 40. The first image is an image corresponding to the image data before rewriting, and the second image is an image corresponding to image data after rewriting. The first image and the second image may be any image. For example, the image may be an image composed of a mixture of the first gray level and the second gray level, or an image in which the entire pixels are either in the first gray level or the second gray level. For changing the display state of the pixel 14 from white to black or from black to white, the controller 20 supplies data signals to the pixel 14 over a plurality of frames, instead of supplying a data signal to the pixel 14 only in one frame, thereby changing the display state. This is because, when the display state is to be changed from white to black or from black to white, the electrophoretic particles do not migrate completely even if the electric field is given to the electrophoretic particles only in one frame. N is an integer of 2 or greater, and may be any arbitrary value by which the electrophoretic particles sufficiently migrate between the electrodes, in other words, the display state sufficiently changes from white to black or from black to white. At room temperature, N may often be set to about 7 to 8. At higher temperatures, N may be about 4 because the response of the electrophoretic particles to the electric field improves. In the present embodiment, an exemplary case where N is 4 will be described for simplifying the description. In other words, when changing the display state of the pixel 14 from white to black, the controller 20 supplies the data signal to the pixel 14 over four frames, to make the pixel 14 to display black. As a result, the voltage of +15V (an example of the first voltage) is applied to the pixel electrode 114 over four frames. On the other hand, when the display state of the pixel 14 is changed from black to white, the data signal to make the pixel to display white is supplied to the pixel 14 over four frames. As a result, the voltage of −15V (an example of the second voltage) is applied to the pixel electrode 114 over four frames.

The application control device 202 controls the application device 201 such that a first image displayed with a plurality of pixels composing the entirety or a part of the display section 10 is changed to an image in the first gray level displayed with the plurality of pixels, and thereafter a second image is displayed with the plurality of pixels. Furthermore, the application control device 202 controls the application device 201 such the numbers of application of the first voltage and the second voltage to each of the plurality of pixels become equal to each other from a state in which each of the plurality of pixels lastly assumed the first gray level before the first image is displayed until a state in which each of the plurality of pixels assumes the first gray level first time after the first image is displayed.

Figures 6A, 6B, 6C, 6D, 6E, 6F:
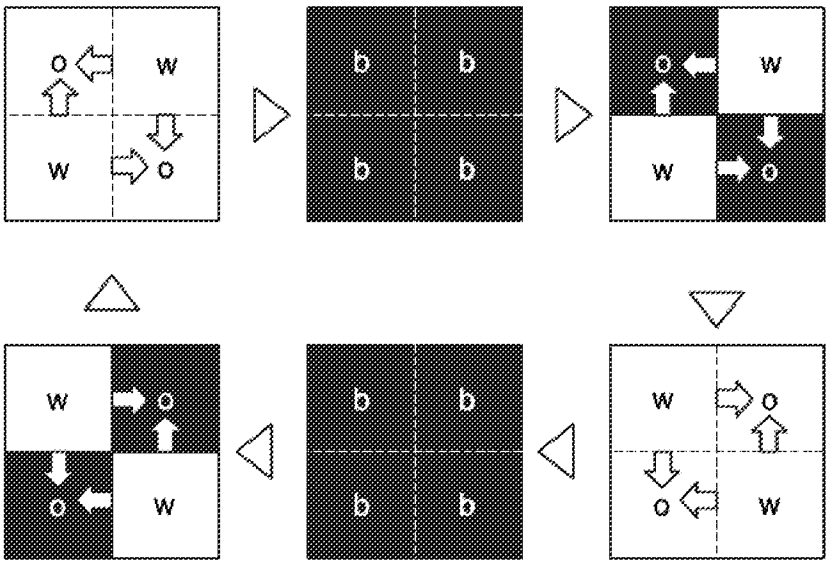
FIGS. 6A-6F are illustration for describing occurrence of blurring.

Here, the problem of the related art will be described. FIGS. 6A-6F illustrate an example of generation of blurring. In this example, the display area 15 in the display section 10 is divided into two areas vertically and horizontally, respectively, thereby forming four small areas in total. In this example, each of the small areas displays either a white image or a black image. White is displayed in all of the small areas in FIGS. 6A and 6D. Black is displayed in all of the small areas in FIGS. 6B and 6E. In FIG. 6C, black is displayed in the upper left and lower right small areas, and white is displayed in the upper right and lower left small areas. In FIG. 6F, white is displayed in the upper left and lower right small areas, and black is displayed in the upper right and lower left small areas. In this example, the case where images from FIGS. 6A to 6F are repeatedly displayed in this order is considered.

A sign "o" shown in the small areas indicates that a voltage o (o=EPcom) that makes the potential difference of the pixel electrode 114 with respect to the common electrode 131 to be 0V is applied to the pixel electrode 114. A sign "w" indicates that a voltage that changes the display state of the pixel 14 from black to white, in other words, a voltage w that makes the potential difference of the pixel electrode 114 with respect to the common electrode 131 to be −15V is applied to the pixel electrode 114. A sign "b" indicates that a voltage that changes the display state of the pixel 14 from white to black, in other words, a voltage b that makes the potential difference of the pixel electrode 114 with respect to the common electrode 131 to be +15V is applied to the pixel electrode 114. As described above, the voltage w and the voltage b are applied over four frames.

White arrows extending from a boundary between adjacent small areas indicate the direction of blurring of the white display that can occur between mutually adjacent small areas. In FIGS. 6A, 6C, 6D, and 6F, because the small area with the voltage o and the small area with the voltage w are adjacent to each other, current leaks from the small area with the voltage o to the small area with the voltage w, such that, in the small area with the voltage o, the pixel electrode 114 in the vicinity of the boundary with the small area with the voltage w is negatively charged with respect to the common electrode 131. Then, the black electrophoretic particles are drawn to the side of a negatively charged portion of the pixel electrode 114, and the white electrophoretic particles are drawn to the side of the common electrode 131, such that white blurring extending from the boundary into the small area with the voltage o can be seen. Note that current leakage that can cause white display blurring in the directions shown in FIGS. 6A and 6B occurs, such that, in the small area with the voltage o, the pixel electrode 114 in the vicinity of the boundary with the small area with the voltage w is negatively charged. However, because leakage occurs between small areas that display white, the blurring is hardly visually recognized.

In the example of FIGS. 6A-6F, when rewriting of the display section 10 is repeated many times in the order of FIGS. 6A, 6B, 6C, . . . , 6F, 6A, . . . , the numbers of application of the voltage w and the voltage b in each of the small areas become equal, and they are balanced. However, independently from the above, in FIGS. 6A, 6C, 6D and 6F, because the voltage with the same polarity (in this example, the negative polarity) is repeatedly applied to the pixel electrode 114 by the leakage current in the vicinity of the boundary between the small areas, the DC balance becomes biased to the negative polarity side in the vicinity of the boundary between the small areas. In the area where the DC balance is upset in a manner described above, corrosion of the pixel electrode 114 and deterioration of the electrophoretic layer 12 are caused. Therefore, the DC balance is desirably achieved, taking into consideration not only the balance between the numbers of application of the voltage w and the voltage b in each of the small areas, but also the voltage based on current leakage in the vicinity of the boundary.

Figures 7A, 7B, 7C, 7D, 7E, 7F, 7G, 7H:
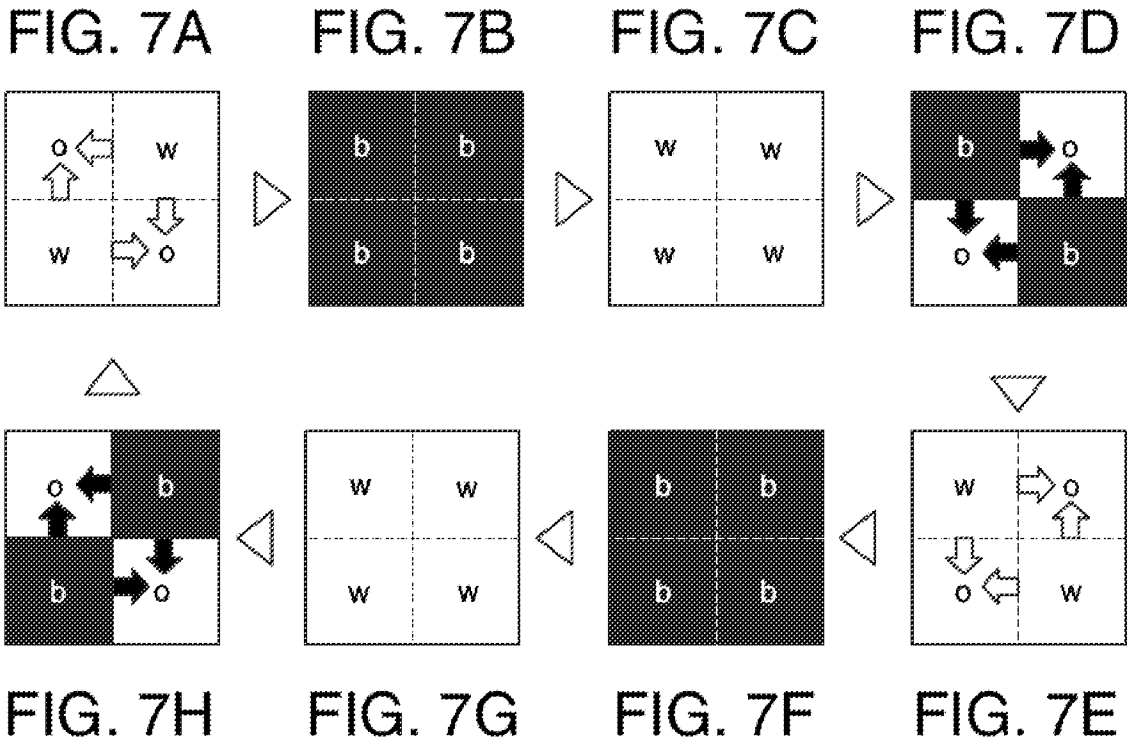
FIGS. 7A-7H show an example in which rewriting of an image is executed with a drive table.

FIGS. 7A-7H illustrate a rewriting sequence that does not cause the problem described above. The case where images of FIGS. 7A-7H are repeatedly displayed in this order is considered. In FIGS. 7A, 7C, 7E and 7G, white is displayed in all of the small areas. In FIGS. 7B and 7F, black is displayed in all of the small areas. In FIG. 7D, black is displayed in the upper left and lower right small areas, and white is displayed in the upper right and lower left small areas. In FIG. 7H, white is displayed in the upper left and lower right small areas, and black is displayed in the upper right and lower left small areas.

White arrows extending from a boundary between adjacent small areas indicate the direction of blurring of the white display that can occur between mutually adjacent small areas. Black arrows extending from a boundary between adjacent small areas indicate the direction of blurring of the black display that can occur between mutually adjacent small areas. In FIGS. 7A and 7E, current leaks from the small area with the voltage o to the small area with the voltage w, similarly to FIG. 6. As a result, in the small area with the voltage o, the pixel electrode 114 in the vicinity of the boundary with the small area with the voltage w is negatively charged with respect to the common electrode 131, such that white display blurring may occur. However, because the small area where the blurring occurs also displays white, the blurring is hardly visually recognized.

In FIGS. 7D and 7H, because the small area with the voltage o and the small area with the voltage w are adjacent to each other, current leaks from the small area with the voltage b to the small area with the voltage o, such that, in the small area with the voltage o, the pixel electrode 114 in the vicinity of the boundary with the small area with the voltage b is positively charged with respect to the common electrode 131. Then, the white electrophoretic particles are drawn to the side of a positively charged portion of the pixel electrode 114, and the black electrophoretic particles are drawn to the side of the common electrode 131, such that black blurring extending from the boundary into the small area with the voltage o can be seen.

In the example of FIGS. 7A-7H, when rewriting of the display section 10 is repeated many times in the order of FIGS. 7A, 7B, 7C, . . . , 7H, 7A, . . . , the numbers of application of the voltage w and the voltage b in each of the small areas become equal, and they are balanced. In addition, the voltages based on current leakage in the vicinity of the boundary are also DC-balanced. More specifically, focusing on the upper left and lower right small areas, the pixel electrodes 114 in the vicinity of the boundary are negatively charged with respect to the common electrode 131 in FIG. 7A, but positively charged in FIG. 7H, such that the voltages based on current leakage in the vicinity of the boundary are DC-balanced in view of the conditions in FIGS. 7A to 7H considered as a whole. Similarly, focusing on the upper right and lower left small areas, the pixel electrodes 114 in the vicinity of the boundary are negatively charged with respect to the common electrode 131 in FIG. 7E, but positively charged in FIG. 7D, such that the voltages based on current leakage in the vicinity of the boundary are DC-balanced in view of the conditions in FIGS. 7A to 7H considered as a whole.

In the image rewriting shown in FIGS. 7A-7H, the DC balance is achieved, even taking into consideration the voltages based on current leakage in the vicinity of the boundaries. As a result, corrosion of the pixel electrodes 114 and deterioration of the electrophoretic layer 12 in the vicinity of the boundaries of the small areas can be suppressed. Here, the reason why the voltages based on current leakage in the vicinity of the boundaries can be DC-balanced in the image rewriting in FIGS. 7A-7H is that the number of applications of negative voltage based on current leakage is equal to the number of applications of positive voltage based on current leakage, as described above. In other words, it is because the number of occurrences of black display blurring and the number of occurrences of white display blurring in a certain small area are equal to each other. Any rewriting sequence, besides the one shown in FIGS. 7A-7H, that meets such requirements, can achieve a similar effect.

Figures 8A, 8B, 8C, 8D, 8E, 8F, 8G, 8H:
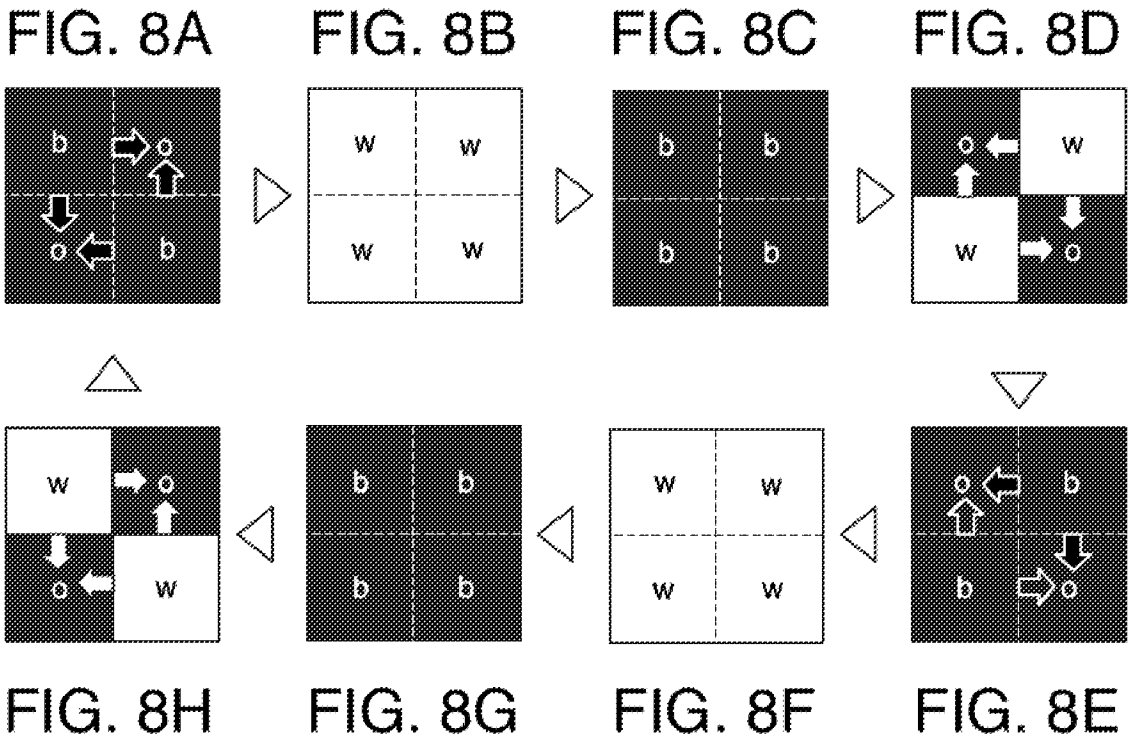
FIGS. 8A-8H show an example in which rewriting of an image is executed with a drive table.

For example, in a rewriting sequence shown in FIGS. 8A-8H, the DC balance is achieved, even taking into consideration the voltages based on current leakage in the vicinity of the boundaries, similarly to FIGS. 7A-7H. In FIGS. 8A, 8C, 8E and 8G, black is displayed in all of the small areas. In FIGS. 8B and 8F, white is displayed in all of the small areas. In FIG. 8D, black is displayed in the upper left and lower right small areas, and white is displayed in the upper right and lower left small areas. In FIG. 8H, white is displayed in the upper left and lower right small areas, and black is displayed in the upper right and lower left small areas. When the images in FIG. 8A to FIG. 8H are repeatedly displayed in this order, in the upper left and lower right small areas, in FIG. 8D, the pixel electrodes 114 in the vicinity of the boundary are negatively charged with respect to the common electrode 131, but positively charged in FIG. 8E, such that the voltages based on current leakage in the vicinity of the boundary are DC-balanced in view of the conditions in FIGS. 8A to 8H considered as a whole. Similarly, in the upper right and lower left small areas, in FIG. 8H, the pixel electrodes 114 in the vicinity of the boundary are negatively charged with respect to the common electrode 131, but positively charged in FIG. 8A, such that the voltages based on current leakage in the vicinity of the boundary are DC-balanced in view of the conditions in FIGS. 8A to 8H considered as a whole.

A method of controlling a display device that can meet the requirement described above, similarly to FIGS. 7 and 8, in which the number of occurrences of black display blurring is equal to the number of occurrences of white display blurring in a predetermined area, will be described.

FIG. 9 shows an ID table. "Initial Value" and "Target Value" are gray levels of the pixel 14 in the $1^{st}$ image and the $2^{nd}$ image, respectively. "TID" (table ID) is an identifier of a driving table to be described later. TID=1, 2, 3 and 4 correspond to rewriting from black to black, rewriting from black to white, rewriting from white to black, and rewriting from white to white, respectively.

FIG. 10 shows a drive table. The drive table is a table that associates changes of voltage with time to be applied to the pixel 14 with each TID. "INDEX" (index) indicates the number of remainder applications of the voltage over a plurality of frames (which includes the voltage application corresponding to the index). The drive table is configured such that the voltage is applied over 20 frames, and when a first image is written to a second image, an all-white image (an example of the first gray level), an all-black image (an example of the second gray level), and an all-white image (an example of the first gray level) are sequentially displayed during the period between the first image and the second image. As described above, the voltage w and the voltage B are applied over four frames, and the drive table is configured such that the voltage o is applied at the last frame in each five frames. Hereunder, in the drive table, a series of drive voltages determined by each TID is called a drive waveform.

In the case of TID=1 (from black to black), because an initial value is black, first, it is rewritten to white by applying the voltage w over four frames and the voltage o over one frame. Next, it is rewritten to black by applying the voltage b over four frames and the voltage o over one frame. Then, it is rewritten to white by applying the voltage w over four frames and the voltage o over one frame. Lastly, it is rewritten to black by applying the voltage b over four frames and the voltage o over one frame.

In the case of TID=2 (from black to white), because an initial value is black, first, it is rewritten to white by applying the voltage w over four frames and the voltage o over one frame. Next, it is rewritten to black by applying the voltage b over four frames and the voltage o over one frame. Then, it is rewritten to white by applying the voltage w over four frames and the voltage o over one frame. Lastly, as the target value is white, the white state is maintained by applying the voltage o over five frames.

In the case of TID=3 (from white to black), because an initial value is white, first, the white state is maintained by applying the voltage o over five frames. Next, it is rewritten to black by applying the voltage b over four frames and the voltage o over one frame. Then, it is rewritten to white by applying the voltage w over four frames and the voltage o over one frame. Lastly, it is rewritten to black by applying the voltage b over four frames and the voltage o over one frame.

In the case of TID=4 (from white to white), because an initial value is white, first, the white state is maintained by applying the voltage o over five frames. Next, it is rewritten to black by applying the voltage b over four frames and the voltage o over one frame. Then, it is rewritten to white by applying the voltage w over four frames and the voltage o over one frame. Lastly, as the target value is white, the white state is maintained by applying the voltage o over five frames.

FIGS. 11A-11E illustrate memory areas of the VRAM 40 and the RAM 50. Here, data corresponding to 16 pixels in total in four rows by four columns are shown for convenience' sake of illustration. Image data shown in FIG. 11A is data indicative of the gray level of each pixel P(j, i) in an image to be displayed in the display section 10, and is stored in the memory area A(j, i) of the VRAM 40. Scheduled image data shown in FIG. 11B is data indicative of the gray level of each pixel P(j, i) in an image scheduled to be displayed in the display section 10, and is stored in the memory area B(j, i) of the RAM 50. The image data and the scheduled image data are two-gray level data, wherein "1" corresponds to white (the first gray level), and "0" corresponds to black (the second gray level). The table ID and the index corresponding to each pixel P(j, i) are stored in the memory areas C(j, i) and D(j, i) of the RAM 50, respectively, as shown in FIGS. 11C and 11D. FIG. 11E shows the gray level of each pixel P(j, i) in an image being displayed in the display section 10. In the present embodiment, an all-white image is assumed to be displayed in the initial state.

Operation of Embodiment

Figure 12:
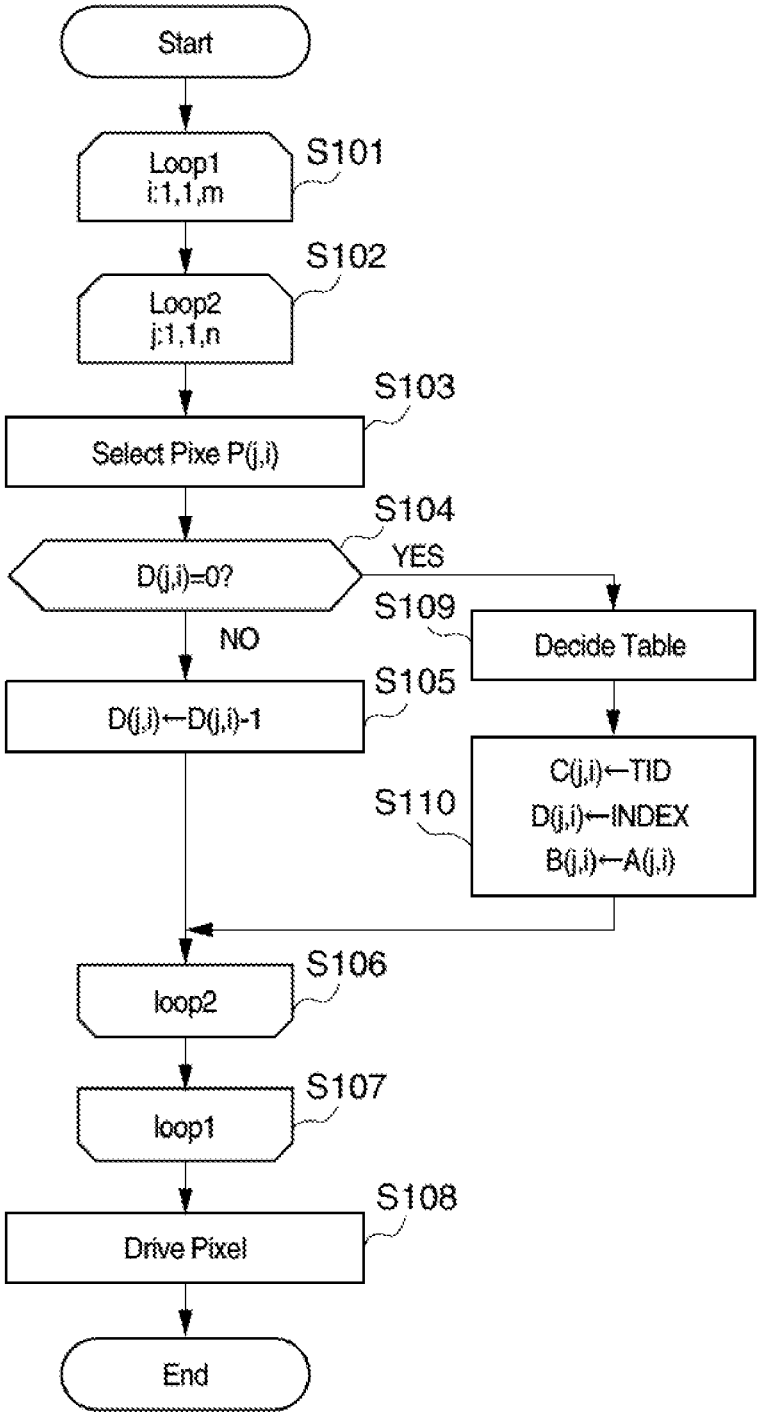
FIG. 12 is a flow chart of operations of the controller 20 in one frame period.

FIG. 12 is a flow chart showing operations of the controller 20 in one frame period. In step S101, the controller 20 initializes the variable i. In step S102, the controller 20 initializes the variable j. In step S103, the controller 20 selects a pixel P(j, i) specified by the variables i and j.

In step S104, the controller 20 judges as to whether an index D(j, i) corresponding to the pixel P(j, i) is 0. When the index D(j, i) is not 0 (step S104: NO), it proceeds to step S105, and when the index D(j, i) is 0 (step S104: YES), it proceeds to step S109. The controller 20 subtracts one from the index D(j, i) in step S105.

In step S109, the controller 20 decides a drive table for changing the gray level of the pixel P(j, i) from the gray level expressed by the scheduled image data of the memory area B(j, i) into the gray level expressed by the image data of the memory area A(j, i). Concretely, the gray level expressed by the scheduled image data of the memory area B(j, i) is assumed to be an initial value, the gray level expressed by the image data of the memory area A(j, i) is assumed to be a target value, and a table ID corresponding to this initial value and the target value is read from the ID table.

In step S110, the controller 20 writes the extracted table ID in the memory area C(j, i), writes 20 that is the first value of the index in the memory area D(j, i), writes image data read from the memory area A(j, i) in the memory area B(j, i), and proceeds to step S106.

In step S106, the controller 20 judges as to whether the variable j has reached n, returns to step S102 when it has not reached n, adds one to the variable j, and proceeds to step S103. When the variable j has reached n, it proceeds to step S107. In step S107, the controller 20 judges as to whether the variable i has reached m, returns to step S101 when it has not reached m, adds one to the variable i, and proceeds to step S102. When the variable i has reached m, it proceeds to step S108. In step S108, the controller 20 reads an application voltage that corresponds to the table ID and the index decided to each pixel from the drive table, and drives each pixel according to the application voltage.

FIGS. 13A-13E illustrate memory content of each of the memory areas when the display section 10 where an all-white image was displayed is rewritten. It the image data written in the VRAM 40, it shows that white is written in the pixels P(1, 1), P(2, 1), P(1, 2), P(2, 2), P(3, 3), P(4, 3), P(3, 4) and P(4, 4), and black is written in the other pixels. Here, because the indexes of all the pixels are 0, in FIG. 11, the judgment in the first frame in step S104 becomes YES about all the pixels. In step S109, the table ID=4 is decided for the pixels P(1, 1), P(2, 1), P(1, 2), P(2, 2), P(3, 3), P(4, 3), P(3, 4) and P(4, 4), and the table ID=3 is decided for the other pixels. In step S111, the table ID=4, the index=20 and the gray level value=1 are written in the memory areas C, D and B, respectively, corresponding to the pixels P(1, 1), P(2, 1), P(1, 2), P(2, 2), P(3, 3), P(4, 3), P(3, 4) and P(4, 4), respectively, and the table ID=3, the index=20 and the gray level value=0 are written in the memory areas C, D and B, respectively, corresponding to the other pixels. FIGS. 13A-13E show the memory content of each of the memory areas at this stage.

Next, in step S108, an application voltage corresponding to the table ID and the index described above is read from the drive table, and this application voltage is impressed to each of the pixels 14. Thereafter, the processings from the $2^{nd}$ frame to the $20^{th}$ frame are executed according to the flow diagram in FIG. 12, and rewriting of the image is completed. FIGS. 14A-14E illustrate memory contents of the respective memory areas at this stage.

The rewriting method described above is one example of the method of rewriting the display section 10 based on the drive table shown in FIG. 10. However, other arbitrary methods can be used, if they can rewrite a display based on the drive table shown in FIG. 10.

According to the rewriting operation described above, the display of each pixel is rewritten, based on the gray level value of an image before rewriting (the first image), and the gray level value of the image after rewriting (the second image), using one of the drive waveforms shown in FIG. 10. In that case, all the pixels become white display at the index=16, after the rewriting from the first image began, become black display at the index=11, become white display at the index=6, and thereafter become the display with the gray level values in the second image. In other words, the application control device 202 controls the application device 201 such that the gray level of the plurality of pixels of the display section 10 displaying the first image is sequentially changed to white display, black display and white display, and then the second image is displayed.

Note here that each of the pixels has been rewritten with one of the drive waveforms of FIG. 10 before the first image is displayed. In the following description, a drive waveform applied before displaying the first image is called a "prior drive waveform" for convenience' sake, and a drive waveform applied for rewriting from the first image to the second image is called a "post drive waveform."

As for the pixel that displays black in the first image, rewriting has been performed before with a drive waveform whose target value is black among the drive waveforms shown in FIG. 10, that is, a drive waveform of either the table ID=1 or 3. Similarly, for the pixel that displays white in the first image, rewriting has been performed before with a drive waveform whose target value is white among the drive waveforms shown in FIG. 10, that is, a drive waveform of either the table ID=2 or 4. The drive waveforms used for these rewriting correspond to the prior drive waveforms.

Here, let us focus on the pixels that display black in the first image, the voltage b has been applied four times to the focused pixels concerned (with the table ID=1 or 3, and the indexes=5 to 2 in the prior drive waveform) from the state where all the pixels lastly displayed white before the first image (the state at the index=6 in the prior drive waveform). Note that, during this period, black display blurring can occur due to current leakage from the focused pixels concerned in pixels that adjoin the focused pixels concerned among the pixels other than the focused pixels concerned.

As for the focused pixels concerned, the voltage w has been applied four times (with the table ID=1 or 2, and the indexes=20 to 17 in the post drive waveform) until all the pixels become white display first time after the first image (the state at the index=16 in the post drive waveform). Note that, during this period, white display blurring can occur due to current leakage to the focused pixels concerned in pixels that adjoin the focused pixels concerned among the pixels other than the focused pixels concerned.

In this manner, the number of application of the voltage b and the number of application of the voltage w for the focused pixels concerned are controlled to be mutually the same from the state where all the pixels are lastly at the first gray level before displaying the first image until the state where all the pixels become the first gray level first time after displaying the first image.

As a result, the number of occurrences of black display blurring from the focused pixels concerned to adjacent pixels and the number of occurrences of white display blurring can be made equal to each other in the period of the prior drive waveform at the indexes=5 to 2 and in the period of the post drive waveform at the indexes=20 to 17. In other words, for pixels other than the focused pixels concerned, the DC balance can be achieved, taking into consideration the voltages based on current leakage in the vicinity of the boundaries. Note that, during the other period, in other words, during the period at the indexes=15 to 7 in FIG. 10, since the voltage b or the voltage w is applied to all the pixels, blurring due to current leakage in the vicinity of the boundaries would not occur. Therefore, no corruption occurs in the DC balance due to current leakage in the vicinity of the boundaries during this period.

According to the control method described above, whatever image the first image and the second image assume, the numbers of application of the voltage w and the voltage b can be balanced, and voltages based on current leakage in the vicinity of the boundaries can be DC-balanced, such that corrosion of the electrophoretic layer 12 and deterioration of the pixel electrodes 114 can be prevented.

MODIFICATION EXAMPLES

The embodiment described above may be modified as follows. Also, the embodiment and any of the modification examples may be combined. Also, plural modification examples may be combined.

Modification Example 1

In the embodiment described above, an example is described in which, when the first image is rewritten to the second image, an all-white image, an all-black image and an all-white image are sequentially displayed during the period between the first image and the second image. However, during the period between the first image and the second image, an all-black image (an example of the first gray level), an all-white image (an example of the second gray level) and an all-black image (an example of the first gray level) may be sequentially displayed. Further, instead of changing the entire pixels to the second gray level, a third image other than an all-black image and an all-white image may be displayed. Moreover, after sequentially displaying an image or plural images following the third image, the first gray level, and the second image may be displayed.

Modification Example 2

When rewriting the first image to the second image, an all-white image or an all-black image (an example of the second gray level) following the first image may be displayed, and then the second image may be displayed. FIG. 15 shows a drive table that is configured such that the display section 10 displays the first image, an all-white image, and the second image in this order. An ID table that is the same as the one shown in FIG. 9 is used.

Here, let us focus on the pixels that display black in the first image. The voltage b has been applied four times to the focused pixels concerned (with the table ID=1 or 3, and the indexes=5 to 2 in the prior drive waveform) from the state where all the pixels lastly displayed white before the first image (the state at the index=6 in the prior drive waveform). On the other hand, the voltage w has been applied four times to the focused pixels concerned (with the table ID=1 or 2, and the indexes=10 to 7 in the post drive waveform) until all the pixels first become white display after the first image (the state at the index=6 in the post drive waveform).

In this manner, also in the modification example, the number of application of the voltage b and the number of application of the voltage w for the focused pixels concerned are controlled to be mutually the same from the state where all the pixels are lastly at the first gray level before the first image being displayed until the gray level of all the pixels becomes the first gray level first time after the first image being displayed. As a result, the number of occurrences of black display blurring from the focused pixels concerned to adjacent pixels and the number of occurrences of white display blurring can be made equal to each other in the period of the prior drive waveform at the indexes=5 to 2 and in the period of the post drive waveform at the indexes=10 to 7. In other words, for pixels other than the focused pixels concerned, the DC balance can be achieved, taking into consideration the voltages based on current leakage in the vicinity of the boundaries, similarly to the embodiment described above. According to such a configuration, rewriting of an image can be performed at higher speed, compared to the embodiment and the modification example 1.

Modification Example 3

In the embodiment, an example in which image data is in two gray levels is shown. However, image data may be in three or more gray levels. FIG. 16 shows an ID table applicable when image data is in three gray levels of black, gray and white. FIG. 17 shows a drive table. In this example, the voltage application over two frames is required to rewrite gray to white or black, or white or black to gray. In this example, the drive table is configured such that the first image, an all-white image (the first gray level) and the second image are sequentially displayed in the display section 10. However, the first gray level may refer to an all-black image, or an all-gray image in which the entire pixels are gray. When the first gray level refers to an all-gray image, an image composed of relatively numerous intermediate gray levels can be rewritten at high speed.

Modification Example 4

FIG. 18 shows a drive table. This example corresponds to image data in two gray levels, and an ID table that is the same as the one shown in FIG. 9 is used. The drive table is configured such that the voltage w or b is applied only to pixels whose gray level is different between the first image and the second image. When this drive table is used, the electric charge of the pixel electrodes caused by leakage current is not cancelled. However, because the number of frames that is required to rewrite an image is less than that of the drive tables exemplified by the embodiment and the modification examples 1 and 2, such that the highest rewriting speed is achieved. Because of the advantage described above, this drive table and the drive tables illustrated by the embodiment or the modification examples 1 and 2 may be selectively used. For example, the duration since image data on the VRAM 40 has been rewritten until the next image data is rewritten may be measured. When the duration is at a threshold value or greater, the drive table exemplified in the embodiment may be used, and when the duration is less than the threshold value, the drive table exemplified in the present modification example may be used. According to such a configuration, when the frequency of image rewriting is relatively low, deterioration of pixels in the area where current leakage occurs can be controlled. On the other hand, when the frequency of image rewriting is relatively high, an image can be rewritten at high speed.

Modification Example 5

The embodiment described above is configured to regulate the DC balance of voltages based on current leakage with the drive table shown in FIG. 10 and the like for the entire pixels included in the display section 10. However, this configuration may also be applicable for plural pixels that compose a part of the display section 10. According to such a configuration, voltages based on current leakage in the vicinity of boundaries can be DC-balanced in the part of the display section composed of the plural pixels, and corrosion of the pixel electrodes 114 and deterioration of the electrophoretic layer 12 can be prevented.

Modified Example 6

The relation between the processings and the hardware components is not limited to the one explained in the embodiment. For example, the subject that performs the color reduction processing may be the CPU 30, instead of the controller 20.

Modified Example 7

The electronic apparatus 1 is not limited to an electronic book reader. The electronic apparatus 1 may be a personal computer, a PDA (Personal Digital Assistant), a cellular phone, a smartphone, a tablet terminal, or a portable game console. The equivalent circuit of the pixel 14 is not limited to the one described in the embodiment. Switching elements and capacitance elements may be combined in any way, as long as a controlled voltage can be applied between the pixel electrodes 114 and the common electrode 131.

The structure of the pixel 14 is not limited to the one described in the embodiment. For example, the polarities of charged particles are not limited to those described in the embodiment. Black electrophoretic particles may be negatively charged, and white electrophoretic particles may be positively charged. In this case, the polarities of voltages to be applied to the pixels become inversed to the polarities described in the embodiment. Also, the display elements are not limited to electrophoretic type display devices using microcapsules. Other display elements, such as, liquid crystal elements, organic EL (Electro Luminescence) elements or the like may be used.

The entire disclosure of Japanese Patent Application No. 2012-087510, filed Apr. 6, 2012 is expressly incorporated by reference herein.

What is claimed is:

1. A control device that controls a display device equipped with a display section having a plurality of pixels, a plurality of first electrodes each of which corresponds to a pixel, a second electrode provided opposite the plurality of first electrodes, and display elements placed between the first electrodes and the second electrode, the control device comprising:

an application device that applies a first voltage to the first electrode of the plurality of first electrodes multiple times when the gray level of the pixel corresponding to the first electrode is changed from a first gray level to a second gray level, and applies a second voltage having a polarity different from the first voltage to the first electrode of the plurality of the first electrodes multiple times when the gray level of the pixel corresponding to the first electrode is changed from the second gray level to the first gray level; and an application control device that controls the application device to change a first image displayed with a plurality of pixels composing the entirety or a part of the display section to an image in the first gray level displayed with the plurality of pixels, and thereafter display a second image with the plurality of pixels, the application control device controlling the application device such that the numbers of application of the first voltage and the second voltage to each of the plurality of first electrodes are equal to each other from a state in which each of the plurality of pixels lastly assumes the first gray level before the first image is displayed until a state in which each of the plurality of pixels first assumes the first gray level after the first image is displayed.

2. The control device according to claim 1, wherein the application control device controls the application device to sequentially change the first image displayed with the plurality of pixels to an image displayed in the first gray level with the plurality of pixels, to an image displayed in the second gray level with the plurality of pixels, to an image displayed in the first gray level with the plurality of pixels, and to the second image.

3. The control device according to claim 1, wherein the application control device controls the application device to sequentially change the first image displayed with the plurality of pixels to an image displayed in the first gray level with the plurality of pixels, and to the second image.

4. The control device according to claim 1, wherein the application control device controls the application device with a highest or a lowest gray level among M gray levels ($3 \leq M$) as the first gray level.

5. The control device according to claim 1, wherein the application control device controls the application device with an intermediate gray level among M gray levels ($3 \leq M$) as the first gray level.

6. A display device comprising:

a display section having a plurality of first electrodes respectively corresponding to pixels, a second electrode provided opposite the plurality of first electrodes, and display elements placed between the first electrodes and the second electrode; and the control device recited in claim 1.

7. An electronic apparatus comprising the display device recited in claim 6.

8. A control method for controlling a display device equipped with a display section having a plurality of first electrodes each of which corresponds to a pixel, a second electrode provided opposite the plurality of first electrodes, and display elements placed between the first electrodes and the second electrode, the control method comprising:

an application processing of applying a first voltage to the first electrode of the plurality of first electrodes multiple times when the gray level of the pixel corresponding to the first electrode is changed from a first gray level to a second gray level, and applying a second voltage having a polarity different from the first voltage to the first electrode of the plurality of first electrodes multiple times when the gray level of the pixel corresponding to the first electrodes is changed from the second gray level to the first gray level; and an application control processing of controlling voltage application in the application processing to change a first image displayed with a plurality of pixels composing the entirety or a part of the display section to an image in the first gray level displayed with the plurality of pixels, and thereafter display a second image with the plurality of pixels, the application control processing controlling voltage application in the application processing such that the numbers of application of the first voltage and the second voltage to each of the plurality of first electrodes are equal to each other from a state in which each of the plurality of pixels lastly assumes the first gray level before the first image is displayed until a state in which each of the plurality of pixels first assumes the first gray level after the first image is displayed.

* * * * *